US010351335B1

(12) United States Patent
Alonso et al.

(10) Patent No.: US 10,351,335 B1
(45) Date of Patent: Jul. 16, 2019

(54) SPRAY GUN

(71) Applicants: Nelson Alonso, Miami, FL (US); Leonardo Alonso, Miami, FL (US)

(72) Inventors: Nelson Alonso, Miami, FL (US); Leonardo Alonso, Miami, FL (US)

( * ) Notice: Subject to any disclaimer, the term of this patent is extended or adjusted under 35 U.S.C. 154(b) by 0 days.

(21) Appl. No.: 16/215,415

(22) Filed: Dec. 10, 2018

(51) Int. Cl.
*B65D 83/30* (2006.01)
*B65D 83/20* (2006.01)
*B05B 12/00* (2018.01)

(52) U.S. Cl.
CPC ..... *B65D 83/30* (2013.01); *B65D 83/20* (2013.01); *B05B 12/002* (2013.01); *B65D 83/202* (2013.01)

(58) Field of Classification Search
CPC .... B65D 83/20; B65D 83/201; B65D 83/202; B65D 83/203; B65D 83/205; B65D 83/206; B65D 83/207; B65D 83/28; B65D 83/30; B05B 12/002
See application file for complete search history.

(56) References Cited

U.S. PATENT DOCUMENTS

| | | | | |
|---|---|---|---|---|
| 6,029,862 | A * | 2/2000 | Jones | B65D 83/202 222/402.11 |
| 6,390,333 | B1 * | 5/2002 | Bozzo | B05B 15/00 222/113 |
| 6,981,622 | B2 * | 1/2006 | Brody | B65D 83/202 222/153.09 |
| 7,743,950 | B2 * | 6/2010 | Tsai | B65D 83/202 222/323 |
| 7,753,237 | B2 * | 7/2010 | Tsai | B65D 83/202 222/323 |
| 8,052,015 | B2 * | 11/2011 | Huang | B65D 83/202 222/153.09 |
| 8,272,542 | B2 * | 9/2012 | Becker | B65D 83/202 222/323 |
| 8,714,416 | B2 * | 5/2014 | Becker | B65D 83/202 222/1 |
| 2016/0279652 | A1 * | 9/2016 | States, III | B65D 83/24 |

* cited by examiner

*Primary Examiner* — Darren W Gorman
(74) *Attorney, Agent, or Firm* — Christopher J. VanDam, P.A.; Chris Vandam

(57) ABSTRACT

An aerosol can spray gun that accepts a top of an aerosol spray gun. The spray gun includes an integral motorized fan. When the trigger on the spray gun is depressed the aerosol spray can dispensing cap is depressed and simultaneously the fan pushes air out through nozzles in the front of the spray gun to control the spray fan pattern. A tab on the cap ensures that the nozzle on the can is oriented forward. Optionally, the air nozzles in the front of the spray gun can adjust the fan pattern between horizontal and vertical.

6 Claims, 11 Drawing Sheets

SPRAY GUN

OTHER RELATED APPLICATIONS

The present application is a continuation in part of pending U.S. patent application Ser. No. 16/003,346 filed 8 Jun. 2018, which is incorporated herein by reference.

BACKGROUND OF THE INVENTION

Field of the Invention

The present invention relates to spray painting, and more particularly, to an improved spray gun for use with disposable spray paint cans.

Description of the Related Art

Several designs for spray paint tools have been designed in the past. None of them, however, includes a handle for a disposable spray paint can with an internally contained fan as an air source that pushes the paint and helps define a preset spray pattern. Further, the provision of a cap for a spray can has a slot that engages into a tab on the control arm to ensure forward orientation of the spray nozzle enhances the consistent performance of the device.

Applicant believes that the closest reference corresponds to a commercially available handle that affixes to the top of a spray paint can and uses a trigger to mechanically press the can's nozzle. However, it differs from the present invention because the present invention includes an improved mechanism to affix the spray can to the body and has an adjustable externally sourced air delivery means to allow the user to adjust the spray pattern.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a more controllable spray pattern from a disposable spray paint can that has a fan to control the spray pattern integrated into the housing.

It is another object of this invention to provide an improved means to connect the spray paint can to the handle that ensures that the spray nozzle on the can is reliably forward directed with a specialized cap.

It is still another object of the present invention to provide a comfortable and easy way to apply paint from a conventional disposable spray paint can to a surface.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
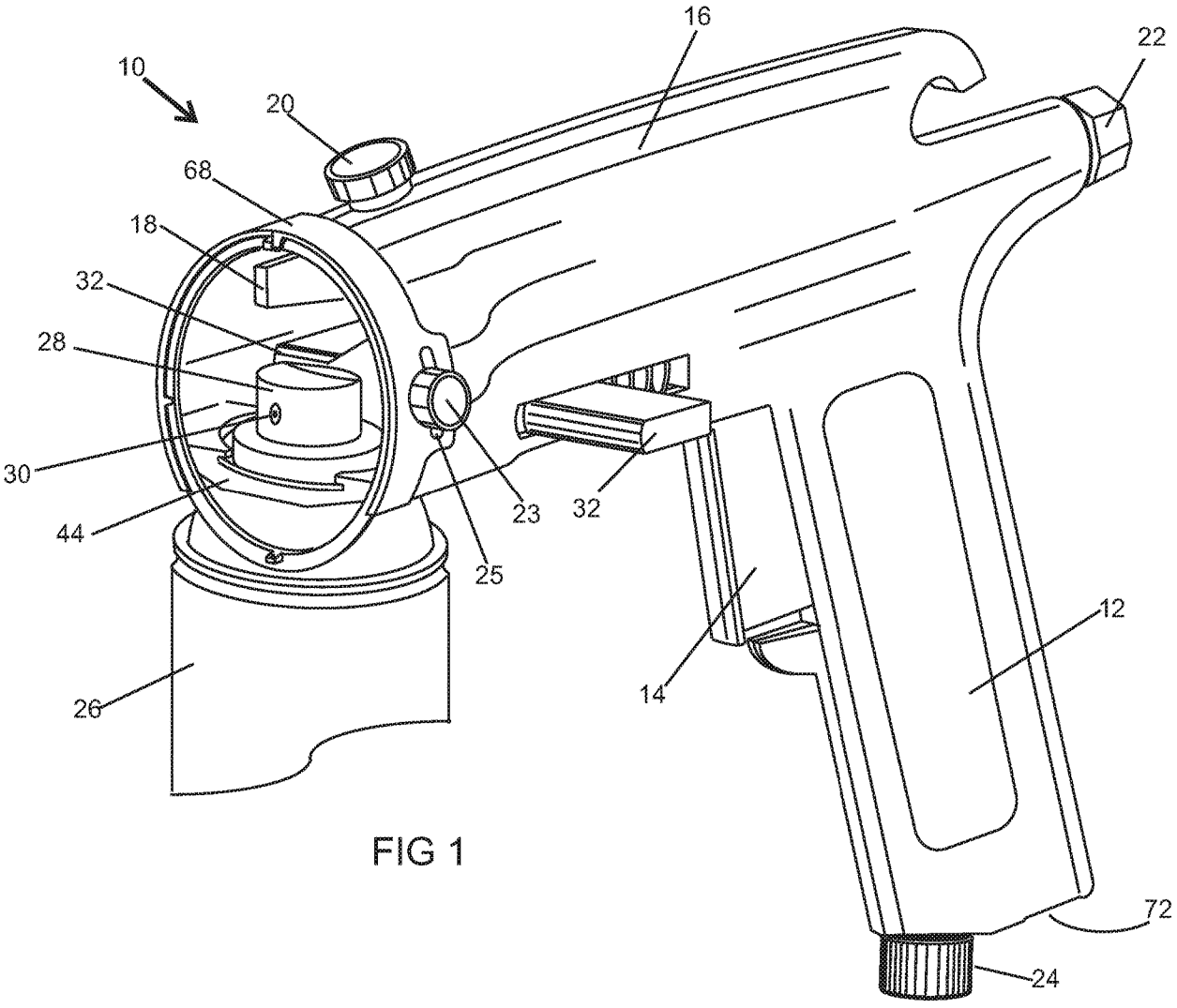
FIG. 1 shows a perspective view of a spray gun.
Figure 2:
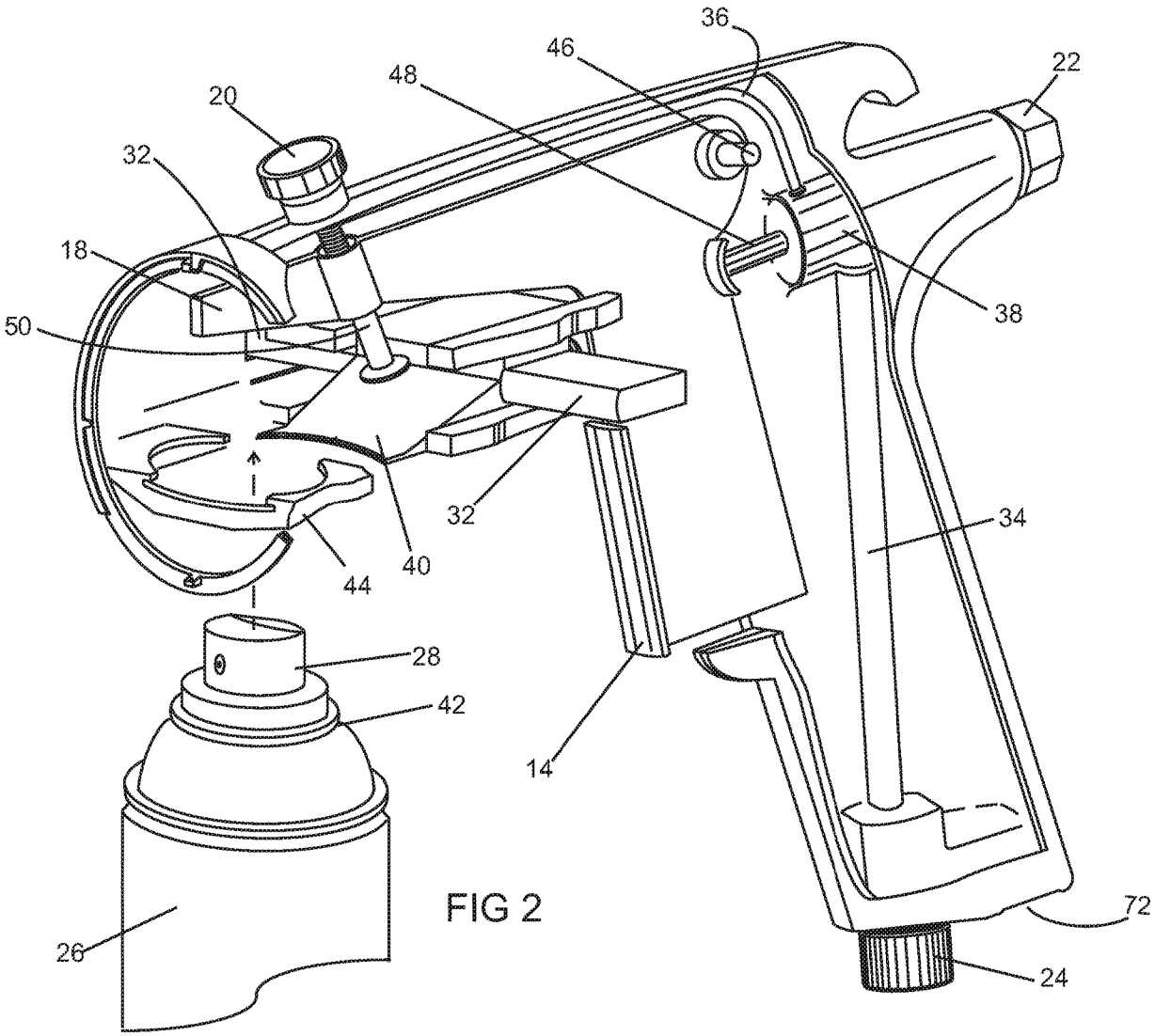
FIG. 2 shows a perspective cross section view of the spray gun.
Figure 3:
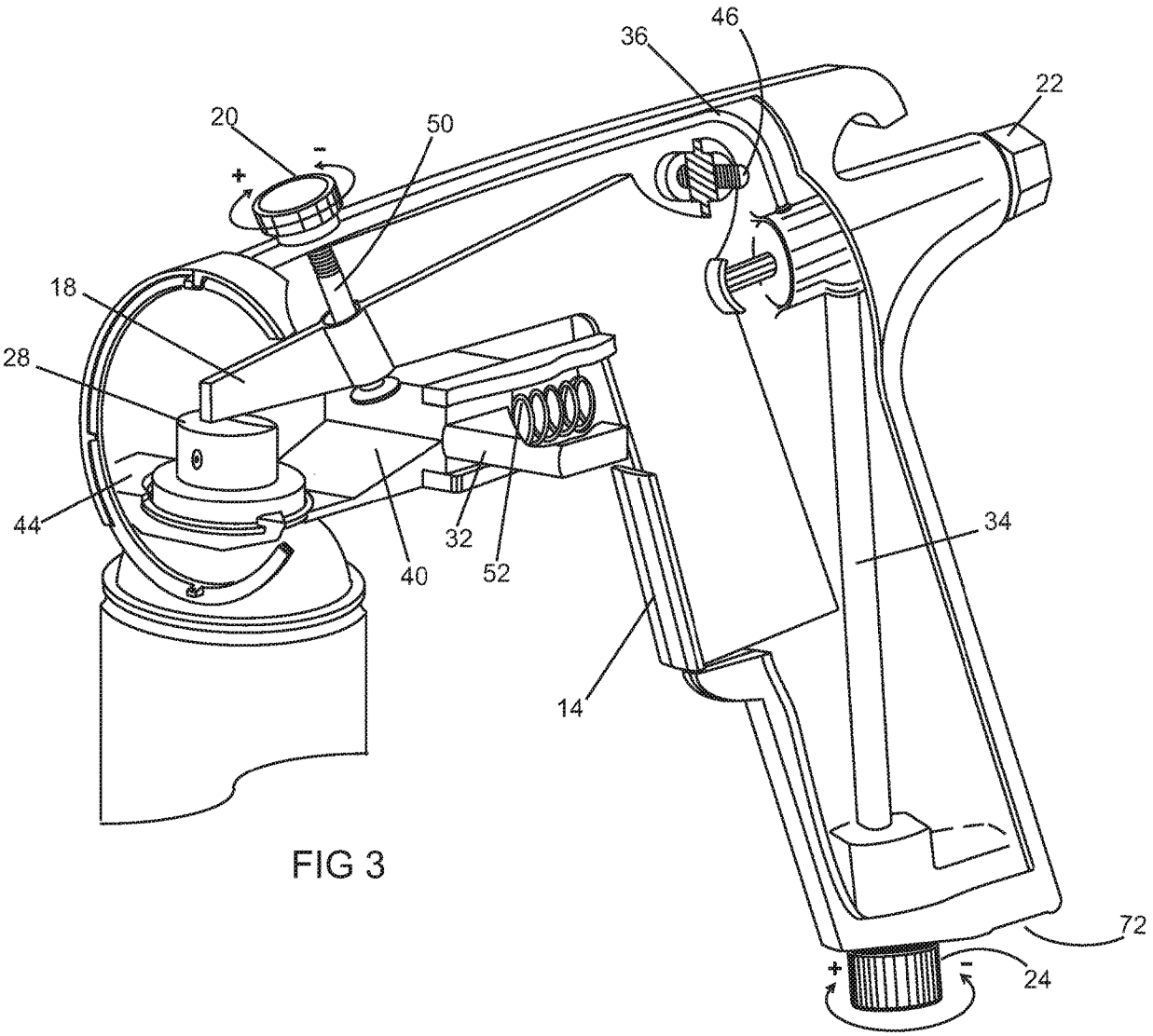
FIG. 3 shows a perspective cross section view of the spray gun.
Figure 5:
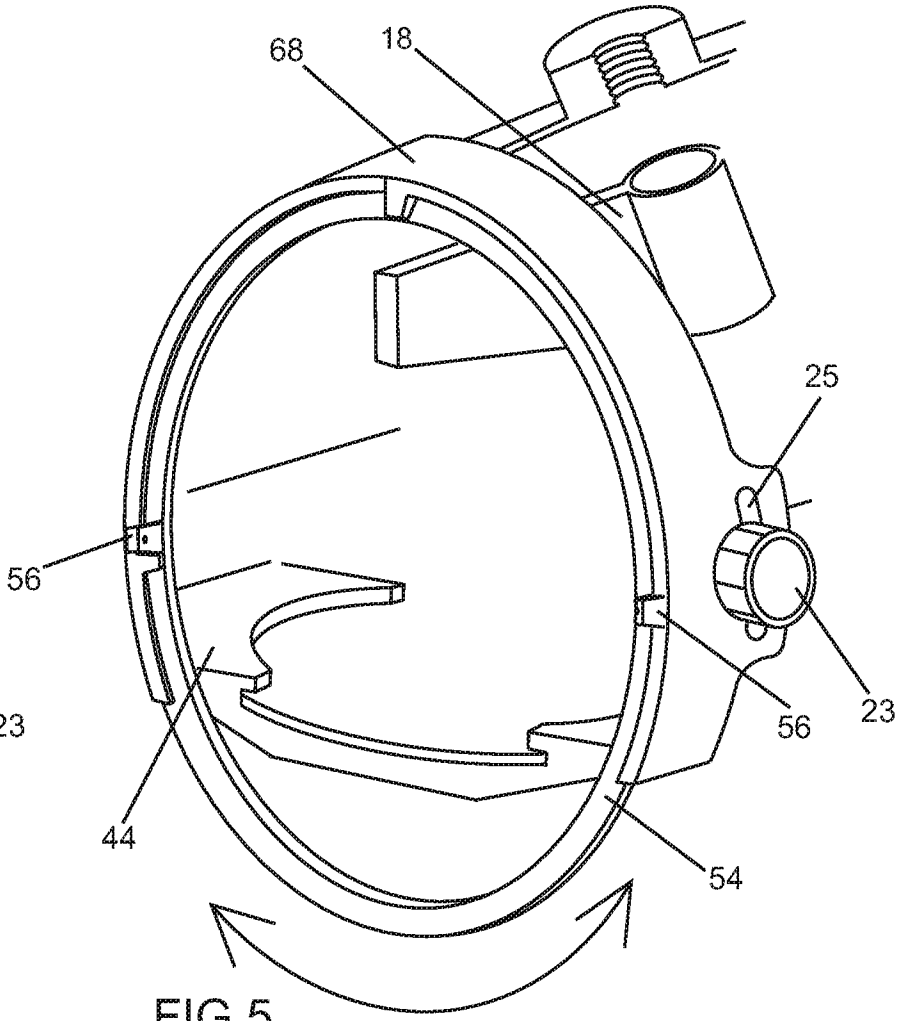
FIG. 5 shows a partial perspective view of the spray gun.
Figure 4:
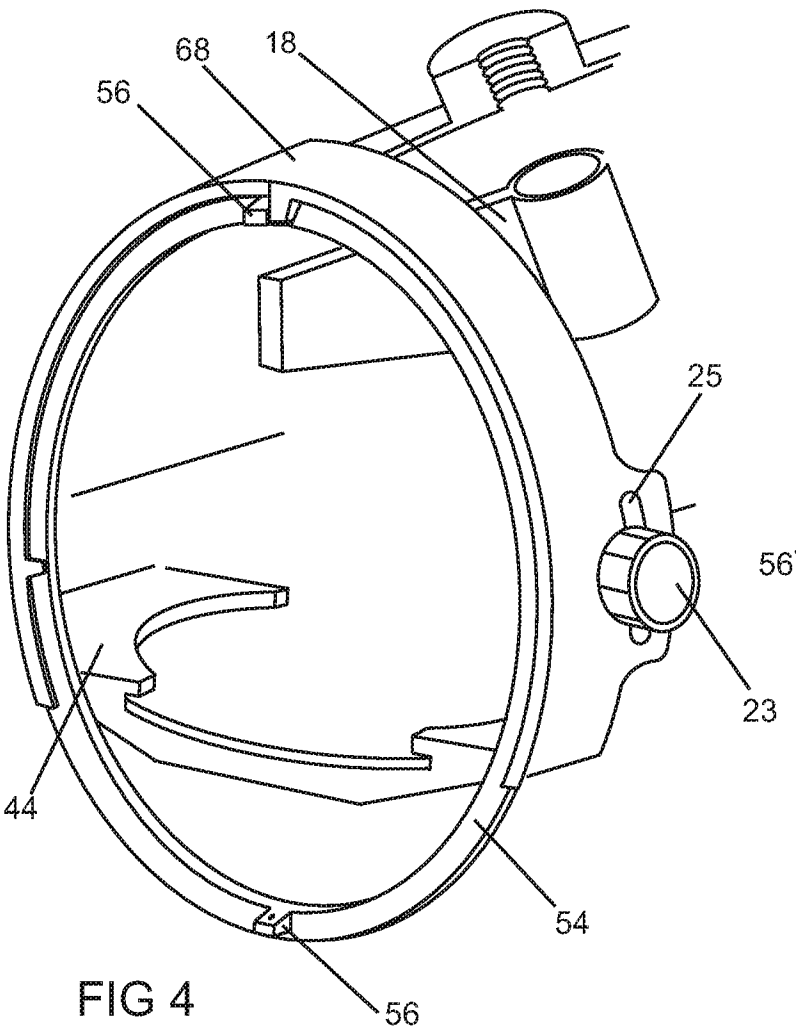
FIG. 4 shows a partial perspective view of the spray gun.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the spray gun, the gun, the sprayer, the painter, machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes, among other features: a handle 12, a trigger 14, a body 16, an arm 18, a control 20, a plug 22, tension nuts 23, a control 24, slots 25, a can 26, a button 28, a nozzle 30, levers 32, a tube 34, a tube 36, a valve 38, a tube 39, a wedge 40, a neck 42, a clip 44, a pivot 46, a rod 48, a rod 50, a spring 52, a ring 54, nozzles 56, a nipple 57, an aperture 58, an aperture 60, a port 62, a plug 64, a plug 66, a track 68, a passage 70 and an inlet 72.

An alternate embodiment of the device is shown in FIGS. 9 through 19 and includes, in addition to many of the parts for the embodiment in FIGS. 1 through 8, a fan 74, a motor 76, a funnel 78, a louver 80, an aperture 82, a tube 84, a nozzle 86, an aperture 87, a surface 88, a cap 89, a slot 90, a nozzle 91, a tab 92, a hook 93, a window 94, a switch 95, a cord 96 and a control 97.

The body 16 of the spray gun contains a motor 76 operably connected to a fan 74. The rear of the gun has a surface 88 with at least one aperture 82. In the version shown in FIG. 10 there are a plurality of apertures 82 that radiate from the center. A louver 80 also has apertures 87 in similar number to the apertures 82 on surface 88.

Figure 12:
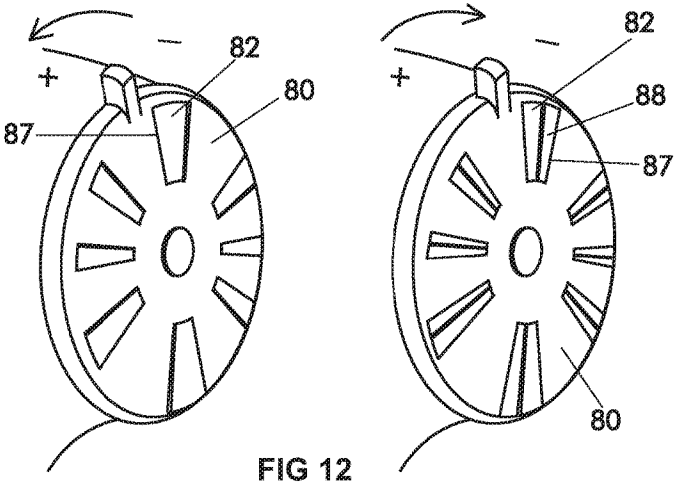
FIG. 12 shows a partial perspective view of a louvers in an open and partially closed mode.
Figure 9:
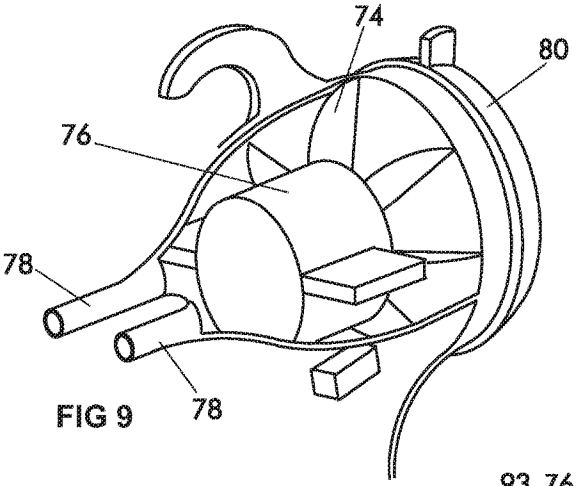
FIG. 9 shows a perspective cross section view of a fan powered spray gun.

The louver 80 rotates about a center point to adjustably align the apertures 87 with the apertures 82 to control the amount of air that the fan 74 will draw into the spray gun. FIG. 12 shows a fully open louver 80 on the left side where the apertures 87 line up completely with the apertures 82 on the surface 88.

The right side of FIG. 12 shows the apertures 87 partially aligned with apertures 82 and partially blocked by the surface of the louver 80. In this mode the airflow into the spray gun is restricted to about half so the fan 74 draws comparatively less air in than the version shown on the left side of this figure. To adjust, the louver 80 is rotated axially as desired by the user of the spray gun.

As air is drawn into the rear of the spray gun by the fan 74 it is ducted through the funnels 78 that further direct the air through the tubes 84 where the air is delivered out the front of the spray gun through nozzles 86. Other channels, tubes or guiding features could direct the airflow from the fan 74 out the front side of the spray gun to help deliver the spray from the can 26 to the substrate being coated.

Figure 11:
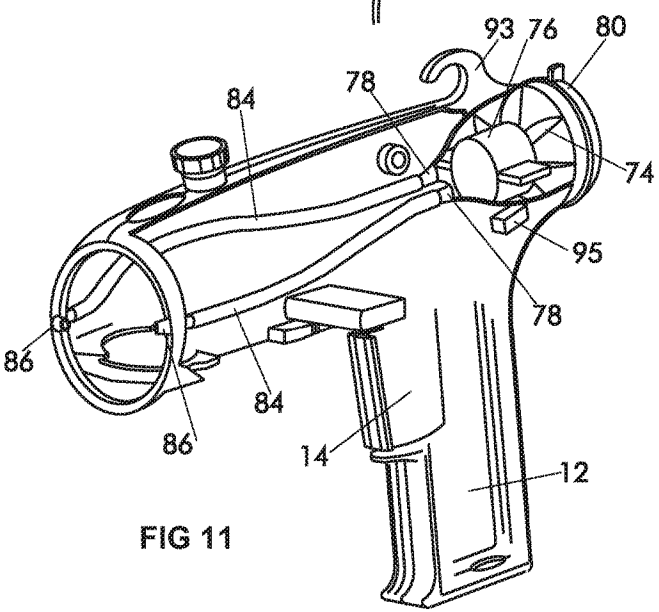
FIG. 11 shows a perspective cross section of a fan powered spray gun.
Figure 14:
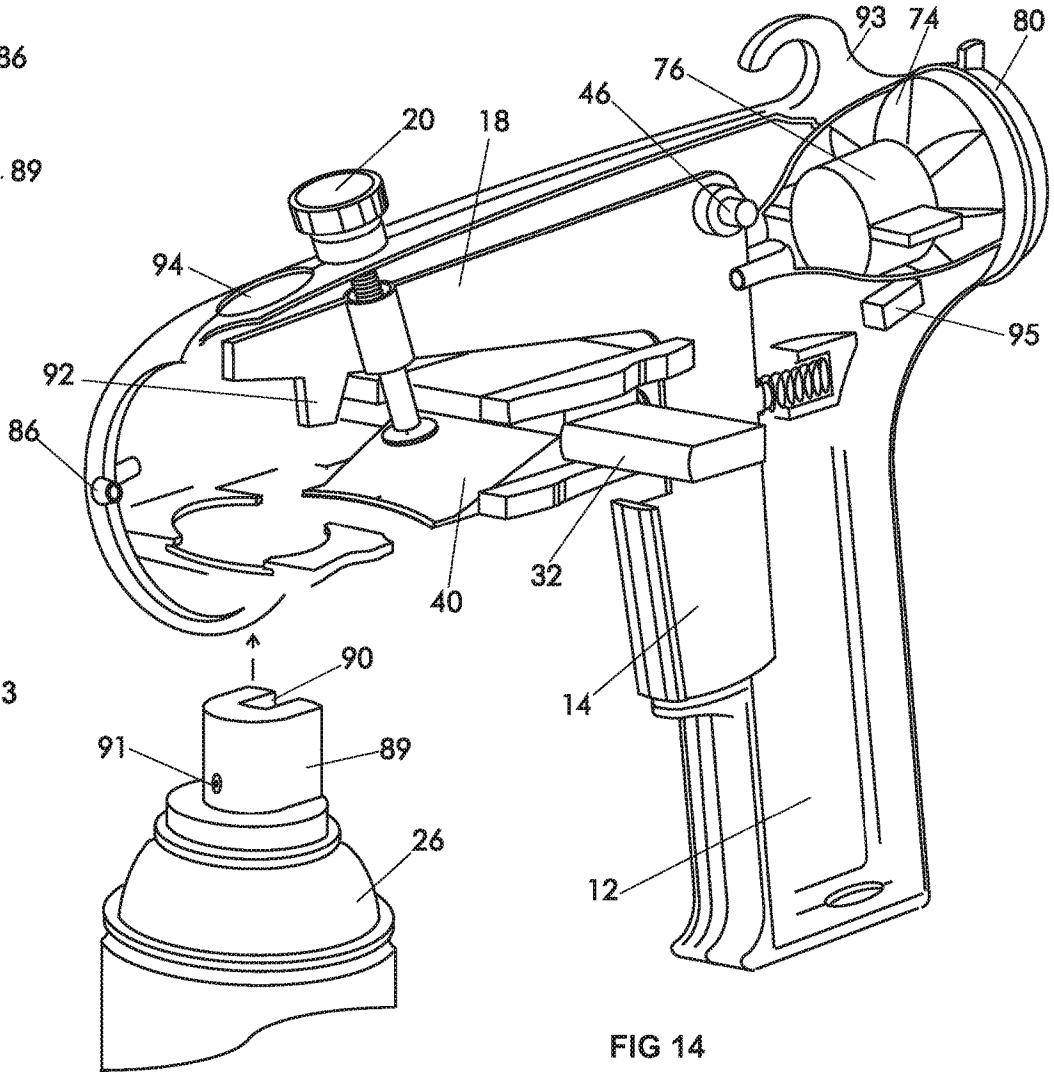
FIG. 14 shows a perspective cross section view of a fan powered spray gun.

The airflow through the nozzles 86 tend to create an air curtain that directs the paint (or other fluid) dispensed from the nozzle 91 on the spray can 26. For example, when oriented at about the three and nine-o-clock positions, as seen in FIG. 11, the airflow will tend to push the sprayed liquid into a vertical fan pattern instead of a more circular patterns as may happen if sprayed directly out of the can 26 without the aid of the present spray gun.

Figure 13:
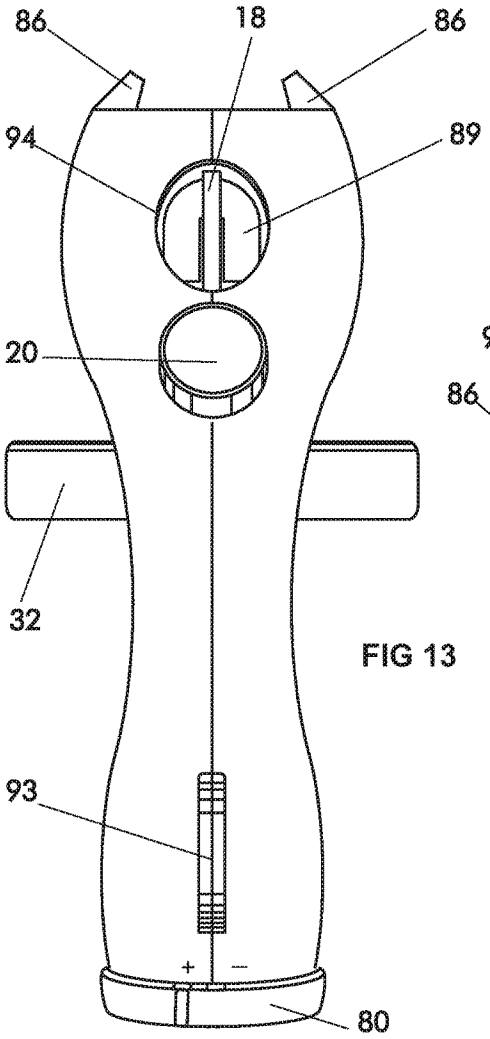
FIG. 13 shows a plan view of a fan powered spray gun.

FIG. 13 shows a top side of the spray gun to demonstrate the features described herein as well as show an example of the window 94 more clearly. The window 94 is an optional element that is made of an aperture or a pane of clear material over an aperture. The window 94 aids in allowing the user to verify that the cap 89 is oriented in the correct position with the nozzle 91 facing forward.

The window 94 is particularly useful in setting up the spray gun when inserting the top of the can 26. The can 26 is held into the spray gun with the wedge 40, or other similar clamping element. The user pulls the wedge 40 back with the lever 32 to open the space for the top of the can 26 and then releases the lever 32 where a spring biases the wedge 40 securely clamping the can 26.

The top of the can 26 containing the material to be sprayed typically is delivered with a suitable cap to spray with for traditional use without the present spray gun device. In one version of the present design the original cap is removed and replaced with a cap 89 as seen in FIGS. 14 through 19. This cap 89 inserts into the same fitting as the original cap in the top of the can 26.

The improved cap 89 has a nozzle 91 similar to the original cap and also includes a slot 90 facing the opposite side of the cap 89 as the nozzle 91. This slot 90 is dimensioned and positioned to accept the tab 92 on the arm 18. The arm 18 is always aligned with the long dimension along the same axis as the direction of the nozzle 91. The arm 18 articulates about the pivot 46 when the trigger 14 is squeezed.

Figure 15:
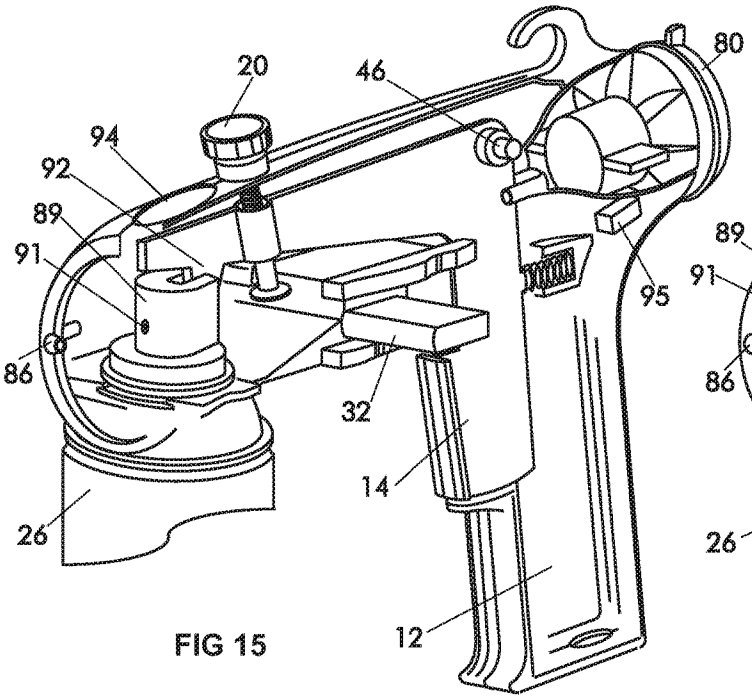
FIG. 15 shows a perspective cross section view of a fan powered spray gun.
Figure 18:
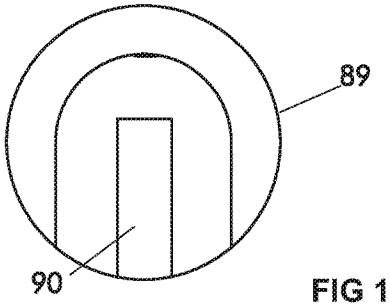
FIG. 18 shows a plan view of a cap used with a fan powered spray gun.
Figure 17:
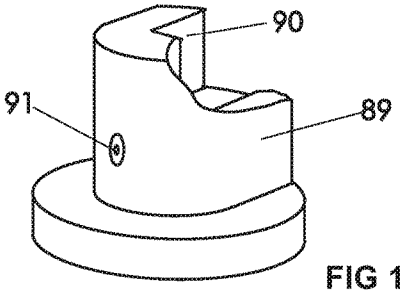
FIG. 17 shows a perspective cross section view of a cap used with a fan powered spray gun.
Figure 19:
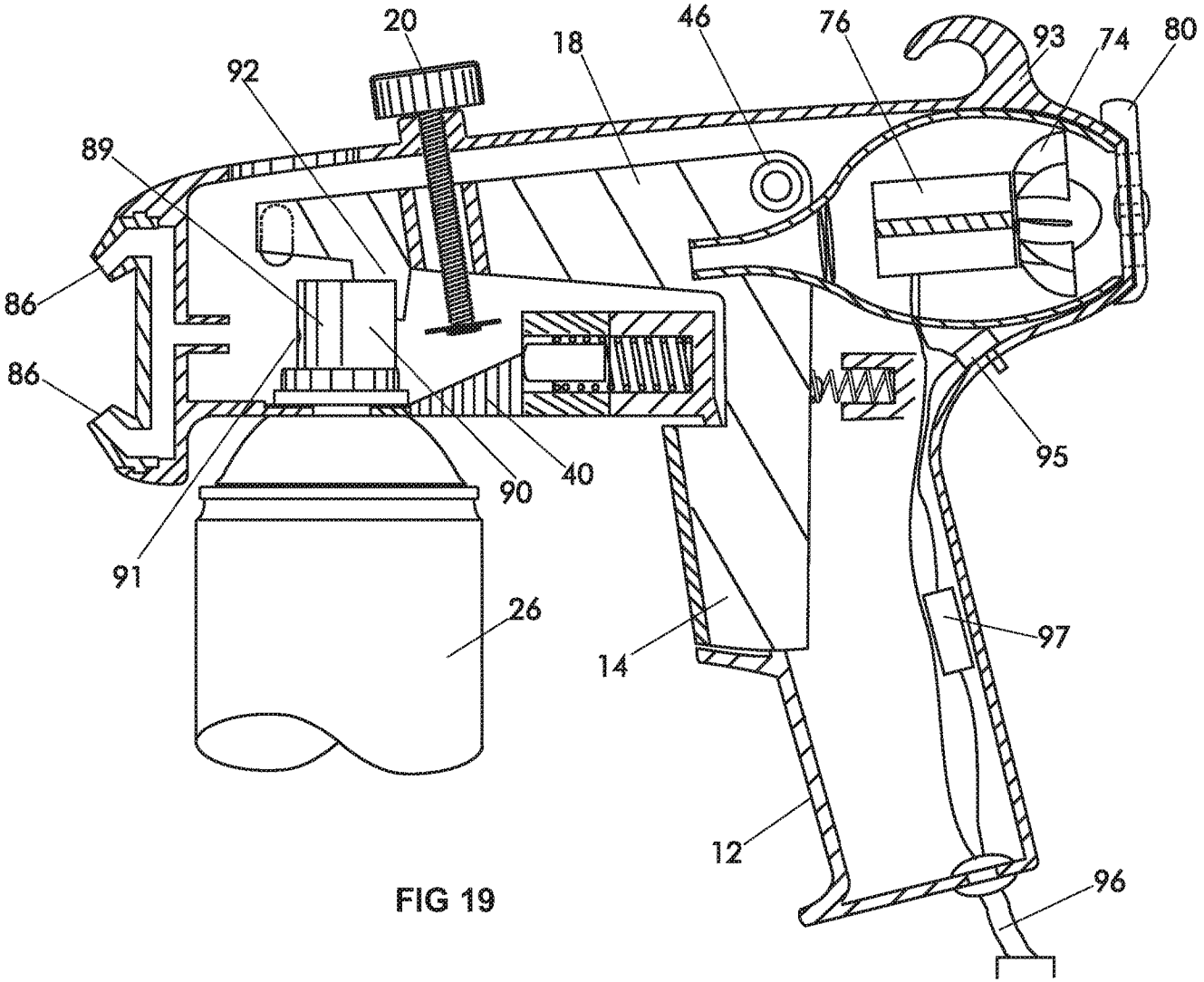
FIG. 19 shows a perspective cross section view of a fan powered spray gun.

The height of the tab 92 is such, in combination with the depth of the slot 90, that the tab 92 remains engaged in the slot 90 whether the arm 18 is raised or lowered. In this way the nozzle 91 remains facing forward regardless of whether the spray gun is in the at rest mode as seen in FIG. 15 or the dispensing mode as seen in FIG. 16.

Figure 16:
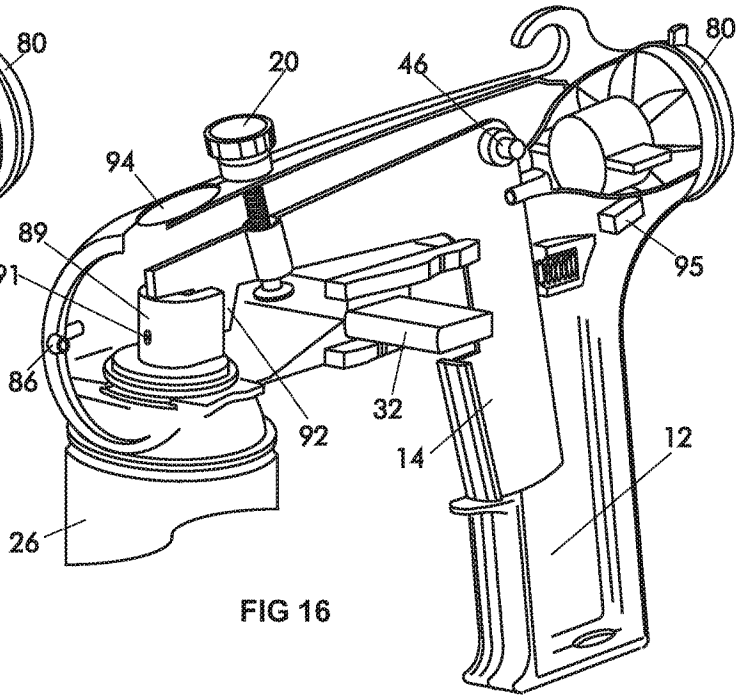
FIG. 16 shows a perspective cross section view of a fan powered spray gun.

When the tab 92 is bottomed out into the slot 90, as in FIG. 16, the spray is caused to be ejected from the nozzle 91 from the pressure of the can 26 while being directed into a fan pattern from the air pushed through the nozzles 86. When pressure from the trigger 14 is released by the hand of the user the arm 18 articulates up and releases pressure on the cap 89, stopping the flow of dispensed fluid through the nozzle 91 and onto the substrate being coated.

The motor 76 powering the fan 74 is generally electrically powered. The motor 76 may be switched on by the operator of the device by activating the switch 95. There may be power cord 96 to supply external power, such as alternating wall current. Powering the motor 76 with a battery contained in the handle 12 or externally is also sufficient to power the motor 76 and attached fan 74. Control 97 may be present to control the speed of the motor 76 and the integral fan 74 by regulating the power to the motor 76.

The body 16 of the spray gun has on a lower end a handle 12 adapted to fit a human hand. The handle 12 is grasped by the operator of the device to support the spray gun and the attached can 26. The position of the users hand on the handle 12 also permits an easy reach to pull the trigger 14 when the user desires to dispense the contents of the can 26.

Pulling the trigger 14 causes several actions to occur inside the body 16. Pulling the trigger 14 towards and into the handle 12 causes the arm 18, which is integrally connected to the trigger 14, to articulate about the pivot 46. When the trigger 14 is pulled back it causes the rod 48 to be pressed into the valve 38. Generally, the further the rod 48 is pressed into the valve 38, the more open the valve 38 will be. Opening of the valve 38 happens a fraction of a second before the button 28 is activated so that the compressed gas begins to flow through the spray gun before the contents of the can 26 begin to dispense.

The valve 38 interconnects tube 34 with tube 36. The valve 38 is normally biased in the closed position thereby isolating tube 34 from tube 36. the tip of the arm 18 is propelled down, towards the button 28 on the can 26. If the trigger 14 is pulled sufficiently, the arm 18 contacts and presses the button 28 to dispense the contents of the can 26.

The control 20 is used to control the depth that the rod 50. The rod 50 traverses the arm 18. The bottom of the rod 50 cannot normally be pulled through the arm 18 and acts as a depth stop limiting how far the arm 18 can travel down effectively limiting how far the button 28 on the can is depressed at maximum trigger 14 pull. By this means a full squeeze of the trigger can be tuned to deliver partial or full dispensation rate of the liquid in the can 26.

The rod 50 may be threaded so that when the control 20 is manipulated the depth stop on the bottom of the rod 50 can be raised and lowered, allowing full or restricted travel range of the arm 18. The travel range of the arm 18 also affects the degree to which the valve 38 opens during a trigger pull event.

Inlet 72 is generally connected to a pressurized air supply. Typically the air supply is an air compressor, but could also be bottled, compressed gas. Opening the valve 38 allows this pressurized gas to flow through tube 34 and into tube 36 towards the dispensing end of the device, near the nozzle 30 on the button 28 of the can 26.

A control 24 is provided near the compressed gas inlet 72 to control the volume of gas that can enter the tube 34 of the spray gun. The control 24 is adjustable by the user of the spray gun from completely stopping any air or other supplied pressurized gas from entering the gun to a restricted or an unrestricted flow.

To secure an aerosol can 26 onto the spray gun the levers 32 is pulled back towards the handle 12 against the spring 52 and the neck 42 of the can 26 is inserted into the clip 44. Pulling the levers 32 compresses the spring 52 and retracts the wedge 40 making an opening to insert the neck 42 of the can 26 into the forward side of the body 16. Once the neck 42 of the can 26 is inserted the levers 32 is released and spring 52 forces the wedge 40 against the neck 42. The clip 44 holds the neck 42 on its forward edge. The combination of the clip 44 and the spring 52 powered wedge 40 holds the can 26 securely in the spray gun.

The spray gun can perform as bleeder style gun if the trigger 14 is depressed partially to open the valve 38 and before the arm 18 starts to depress the button 28 pressurized gas, flows into the gun through inlet 72, through the then open valve 38, through tube 36 and out through port 62 and nozzles 56.

Figure 6:
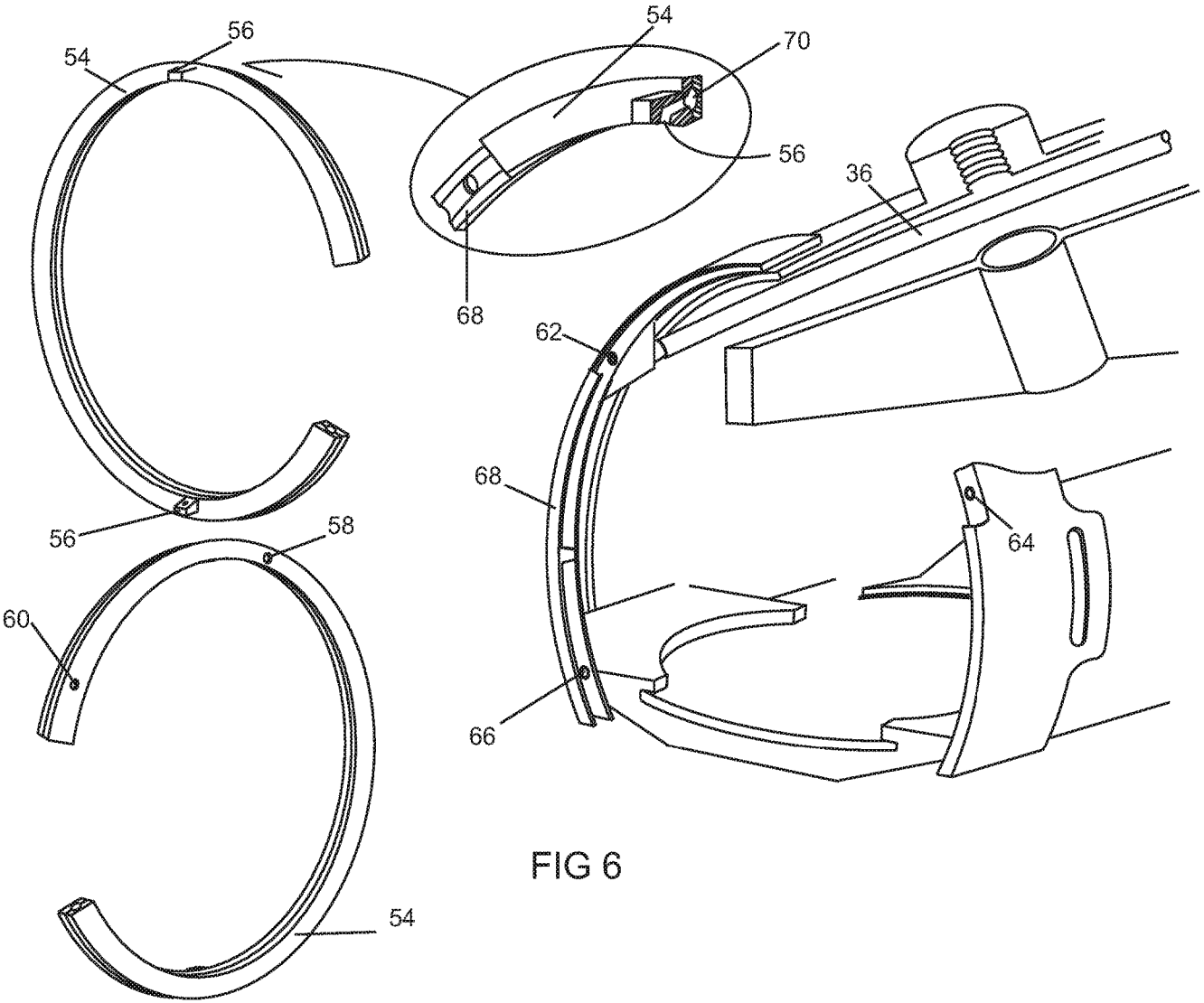
FIG. 6 shows a partial perspective view of the spray gun with front and rear perspective views of a ring 54 and inset detail of the ring 54.
Figure 7:
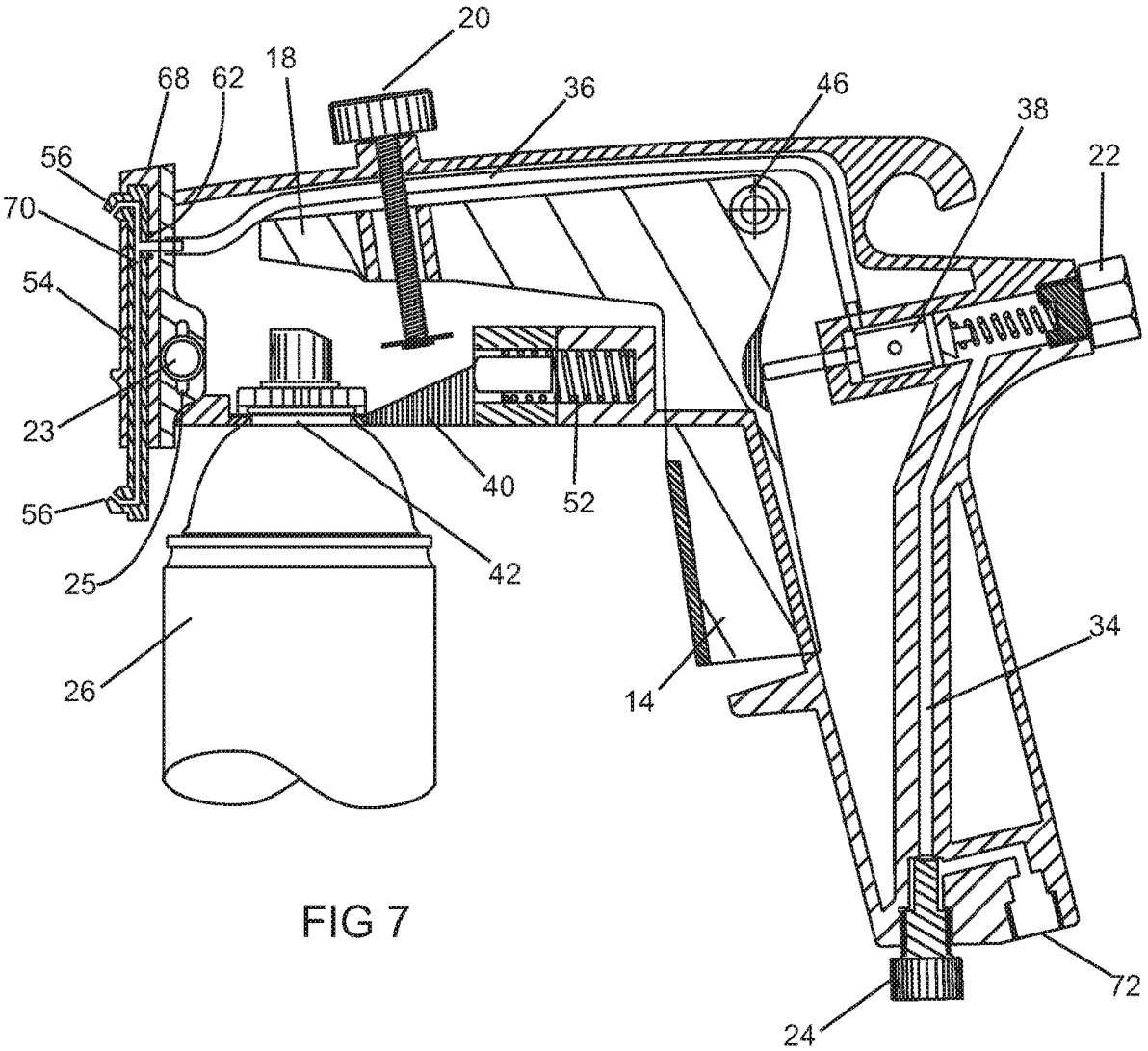
FIG. 7 shows an elevation cross section view of the spray gun.

FIG. 6 shows a partial cross-section of the front end of the spray gun with the ring 54 exploded showing a front and a rear side of the ring 54. The inset on the front view of the ring shows in more detail the configuration of the internal passage 70.

During a normal dispensing operation of the paint gun pressurized air delivered though the inlet 72 begins to flow when the trigger 14 is depressed. The air flows though tube 34, through valve 38, through tube 36, out of port 62 on the track 68, into the aperture 60 on the ring 54 and is distributed through the passage 70 inside the ring 54 where the air exits through both of the nozzles 56.

The two nozzles 56 are generally on opposite sides of the ring 54 and face partially forward away from the nozzle 30 and are angled in towards the opposing nozzle 56 to both propel the dispensed fluid forward, away from the gun and to compress the dispensed fluid into a fan pattern for more controlled application of the fluid. Prior to this design feature no aerosol spray can had the ability to be sprayed in a fan pattern with supplemental pressurized gas.

The ring 54 rides in track 68 so that the ring 54 rotates about the front of the spray gun. The ring 54 includes the nozzles 56 so the nozzles 56 turn as well. When the nozzles 56 are moved into a horizontal configuration (meaning at about three o'clock and nine o'clock) the resulting spray pattern is substantially a vertical fan.

Similarly, when the nozzles 56 are rotated about ninety degrees from horizontal to the vertical (meaning at about twelve o'clock and six o'clock) the resulting spray pattern is substantially horizontal. In this configuration plug 64 seals aperture 60 and the pressurized gas supplied flows through port 62 into aperture 58 and through passage 70 where the pressurized gas exits the device through the nozzles 56.

Aperture 58 and aperture 60 are about a quarter turn apart when plug 66 is positioned by rotating the ring 54 so that aperture 58 is sealed by plug 66 then port 62 is aligned with aperture 60 to supply air through the passage 70 to the nozzles 56. The nozzles are then oriented substantially horizontally.

When returning the ring 54 by rotating the track 68 so that the nozzles are again at six and twelve o'clock the plug 64 is sealing aperture 60 and the aperture 58 is in communication with port 62. Pressurized gas then again flows through tube 36, exiting at port 62 and through aperture 58 into the passage 70 and finally exiting the nozzles 56.

The ring 54 is readily movable between the horizontal and vertical positions. The plug being in the respective aperture also acts as an indexing feature to keep the ring 54 oriented in the configuration that the user selects without accidentally moving out of place during normal and ordinary use applying paint or other dispensed fluid.

The track 68 may include a slot 25 on either side of the front of the body 16 that is used to fix the track 68 in place in the selected configuration by use of a tension nut 23 threaded into the body 16. The slots 25 allow a range of motion of the track 68 up and down relative to the nozzle 30. This allows the user to adjust the center of the track 68 to be centered with the nozzle 30.

By having pressurized air carry the dispensed fluid, more control is afforded the user. The air or other gas entering the handle of the spray gun at inlet 72 can help to carry the fluid dispensed from the can 26 while simultaneously affecting the spray patters into a vertical or horizontal pattern. The several controls allow the user precise control as to how much fluid is dispensed and how much pressurized air is delivered to assist in the spraying process.

Figure 8:
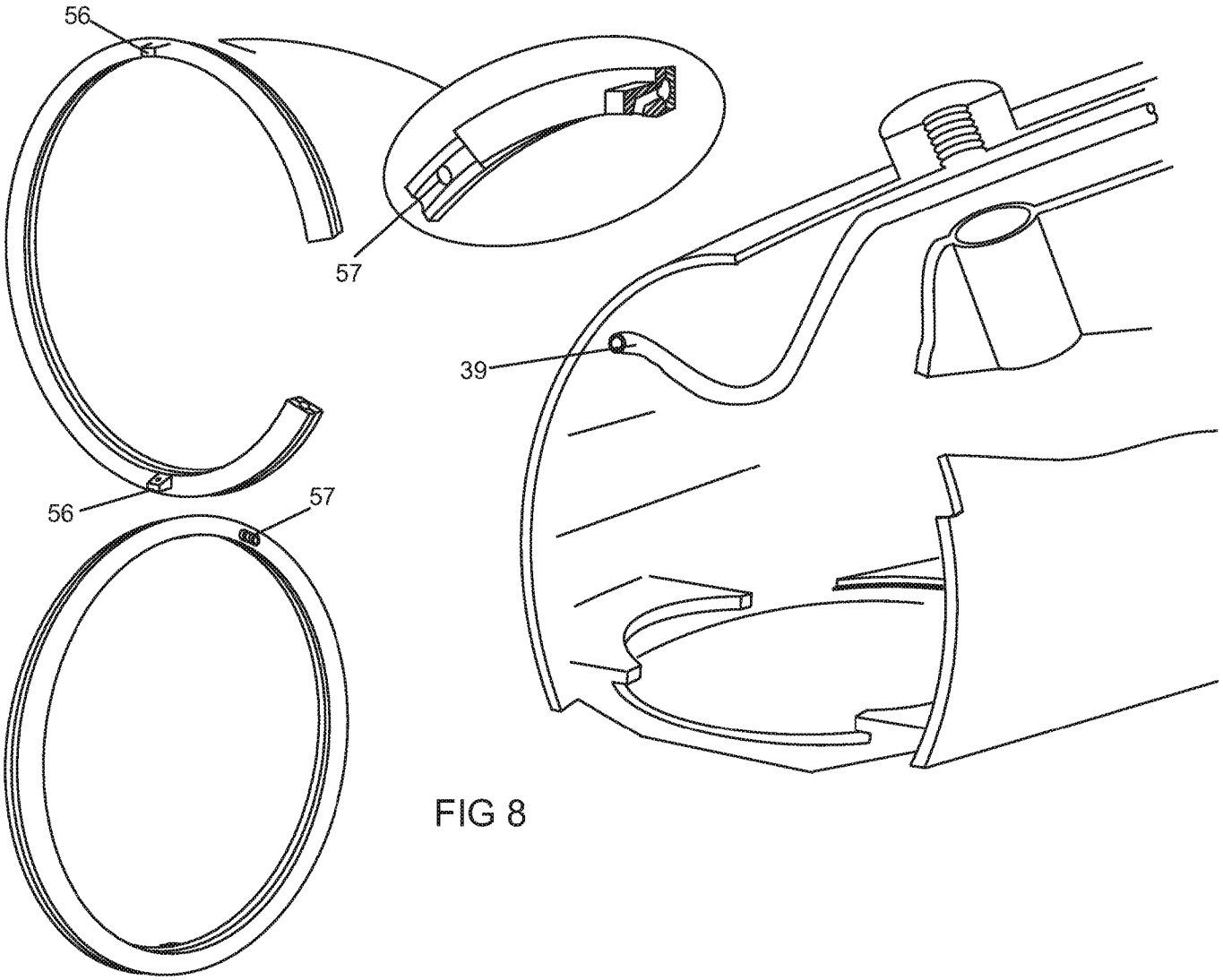
FIG. 8 shows a partial perspective view of a spray gun with front and rear perspective views of a ring and inset detail of the ring.
Figure 10:
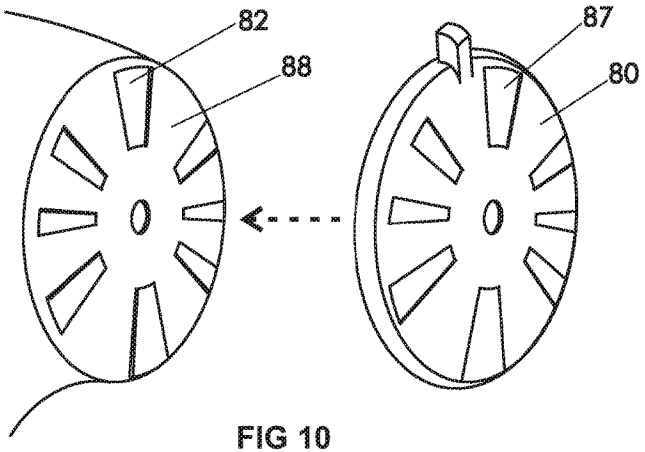
FIG. 10 shows a partial perspective exploded view of a louver assembly.

As an alternative to the above described ring and plug combination, the tube 39 may plug into nipple 57 be movable enough to accommodate a ninety degree rotation of the ring 54 in the track 68, as seen in detail in FIG. 8.

The paint or other fluid dispensed does not come into contact with the spray gun so cleaning is avoided. The pressurized gas tends to carry the fluid away from the balance of the spray gun so it stays clean. This can dramatically reduce the time needed to clean up after a painting or other project is completed.

If no pressurized air is available or is not otherwise utilized, the spray gun may still operate to spray paint. This would not provide the beneficial carrying of paint and directional control of the spray pattern aspects as are shown and described herein.

A version of the present invention can be fairly described as an aerosol can dispensing device comprised of a body and a handle. The handle is dimensioned to be grasped by an average human hand and includes an operable trigger, pressable by the fingers of that hand. A front dispensing end of the body selectively attaches to a neck of an aerosol can so that it is easy to install and remove aerosol cans as they are depleted. The can is clipped in and positions at least a button on the aerosol can inside the front end of the body, but not necessarily the whole can. A pressurized gas from an external source is connected to the handle and is selectively carried in a tube to a nozzle ring at the front end of the body. The tube includes a gas valve that selectively permits flow of the pressurized gas through the tube. The gas valve is biased in a closed position. An arm inside the body pivots on a pivot point when the trigger is depressed causing a rear end of the arm to open the gas valve and allow the pressurized gas to flow through the tube to the nozzle ring and simultaneously or a fraction of a second later causing a front end of the arm to depress the button on the aerosol can to dispense a fluid contained in the aerosol can. The nozzle ring has at least two forward facing nozzles on opposite sides of the nozzle ring where the pressurized gas exits the nozzle ring along with the fluid dispensed from the aerosol can. The nozzle ring is rotatable to orient the forward facing nozzles at a horizontal or a vertical position by rotating it against the front of the gun and yet retaining the connections with the pressurized air. In at least one embodiment of the device the pressurized gas is air, but could also be a dried air, nitrogen or other gas mixture compatible with the dispensed fluid. The fluid dispensed is any of a paint, a colorant, a lubricant or a protectant, essentially any fluid that can be dispensed from an aerosol can.

An important version of the invention can be fairly described as an aerosol can dispensing device comprised of, among other parts, a body and a handle. A electric motor and a fan are operated by a switch integrated into the body to turn the fan on or off. The handle is dimensioned to be grasped by a human hand and includes an operable trigger. A front end of the body attaches to an aerosol can and positions a cap on the aerosol can inside the front end of the body under a tab on an arm. The cap has a slot into which the tab on the arm engages to orient a nozzle on the cap forward so that the can sprays forward. The arm pivots when the trigger is pulled causing the tab at a front end of the arm to press the cap on the aerosol can to dispense a fluid contained in the aerosol can through the front end of the body. The fan draws air into a rear of the body through a louver and ducts air out a pair of opposed nozzles at a front of the body to shape a spray pattern of the fluid dispensing through the front of the body. The louver adjusts to control the amount of air emitted from the opposed nozzles by selectively restricting the amount of air drawn into the body by the fan. Optionally, the opposed nozzles rotate about the front of the body to shape the spray pattern any a predetermined position anywhere between and including horizontal and vertical spray patterns. Optionally, a window is provided on the top of the body to visually ensure engagement of the tab into the slot.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An aerosol can dispensing device comprised of an aerosol can, a body and a handle;

an electric motor and a fan operated by an electrical switch;

the electric motor, the fan and the electrical switch are integrated into the body;

the handle is dimensioned to be grasped by a human hand and includes an operable trigger integrated into the handle;

an upper end of the aerosol can has a cap through which a fluid in the aerosol can exits the aerosol can;

contained within the body is an arm that on a first end thereof is connected to the trigger and on a second end thereof has a tab that contacts the cap of the aerosol can;

a front end of the body attaches to the aerosol can and positions the cap on the aerosol can inside the front end of the body under the tab on the second end of the arm;

an upper surface of the cap has a slot into which the tab on the arm engages to orient a nozzle on the cap forward;

the arm pivots when the trigger is pulled causing the tab at the second end of the arm to press the cap on the aerosol can to dispense the fluid contained in the aerosol can through the front end of the body;

a rear of the body has an integral louver;

the fan draws an air into the rear of the body through the louver and ducts the air through a tube to a pair of opposed nozzles at the front end of the body where the air exits the opposed nozzles to shape a spray pattern of the fluid simultaneously dispensing from the aerosol can through the front end of the body;

the louver adjusts to control the amount of air emitted from the opposed nozzles by selectively restricting the amount of air drawn into the body by the fan.

2. The aerosol can dispensing device in claim 1 further characterized in that the opposed nozzles rotate on a ring anywhere between a first position where the opposed nozzles are vertically oriented and a second position where the opposed nozzles are horizontally oriented to shape the spray pattern of the fluid dispensing from the aerosol can.

3. The aerosol can dispensing device in claim 1 further characterized in that a window is provided on the top of the body to visually ensure engagement of the tab into the slot.

4. The aerosol can dispensing device in claim 2 further characterized in that a window is provided on the top of the body to visually ensure engagement of the tab into the slot.

5. An aerosol can dispensing device comprised of a body and a handle;

the handle is dimensioned to be grasped by a human hand and includes an operable trigger;

a front end of the body selectively attaches to a neck of an aerosol can and positions a cap on the aerosol can inside the front end of the body;

a pressurized gas from an external source is connected to the handle and is carried in a tube to a nozzle ring at the front end of the body;

the tube includes a gas valve that selectively permits flow of the pressurized gas through the tube;

the gas valve is biased in a closed position;

an arm inside the body pivots when the trigger is depressed causing a rear end of the arm to open the gas valve and allow the pressurized gas to flow through the tube to the nozzle ring and simultaneously causing a front end of the arm to depress the cap on the aerosol can to dispense a fluid contained in the aerosol can;

the cap has a slot into which a tab on the front end of the arm engages to orient a nozzle on the cap forward;

the arm pivots when the trigger is pulled causing the tab at the front end of the arm to press the cap on the aerosol can to dispense the fluid contained in the aerosol can through the front end of the body;

the nozzle ring has at least two forward facing nozzles on opposite sides of the nozzle ring where the pressurized gas exits the nozzle ring along with the fluid dispensed from the aerosol can;

the nozzle ring rotates to orient the forward facing nozzles at a horizontal or a vertical position.

6. The aerosol can dispensing device in claim 5 further characterized in that a window is provided on the top of the body to visually ensure engagement of the tab into the slot.

* * * * *